US011478675B2

(12) United States Patent
Chen

(10) Patent No.: US 11,478,675 B2
(45) Date of Patent: Oct. 25, 2022

(54) WEIGHT ADJUSTABLE DUMBBELL

(71) Applicant: Jianxin Chen, Hangzhou (CN)

(72) Inventor: Jianxin Chen, Hangzhou (CN)

( * ) Notice: Subject to any disclaimer, the term of this patent is extended or adjusted under 35 U.S.C. 154(b) by 43 days.

(21) Appl. No.: 17/114,400

(22) Filed: Dec. 7, 2020

(65) Prior Publication Data

US 2022/0176186 A1 Jun. 9, 2022

(51) Int. Cl.
*A63B 21/075* (2006.01)
*A63B 21/072* (2006.01)

(52) U.S. Cl.
CPC ..... *A63B 21/075* (2013.01); *A63B 21/0728* (2013.01)

(58) Field of Classification Search
CPC .. A63B 21/075; A63B 21/0728; A63B 21/072
See application file for complete search history.

(56) References Cited

U.S. PATENT DOCUMENTS 8,025,613 B1 * 9/2011 Wang ..... A63B 21/075 482/107
2008/0146420 A1 * 6/2008 Chen ..... A63B 21/0728 482/108
2017/0239510 A1 * 8/2017 Wang ..... A63B 21/0724
2018/0169459 A1 * 6/2018 Wang ..... A63B 21/4035
2018/0264308 A1 * 9/2018 Wang ..... A63B 21/075
2018/0353794 A1 * 12/2018 Wang ..... A63B 71/0036
2020/0330813 A1 * 10/2020 Liu ..... A63B 21/0722

FOREIGN PATENT DOCUMENTS

CN 206350893 U * 7/2017

* cited by examiner

*Primary Examiner* — Erin Deery
*Assistant Examiner* — Peter H Forstner

(57) ABSTRACT

A weight adjustable dumbbell, which includes a dumbbell bar assembly, a dumbbell base and a plurality of dumbbell plates placed on two sides of the dumbbell base. The dumbbell bar assembly includes a plurality of synchronously rotatable hanging plates arranged adjacently, an end of each of the hanging plates is provided with an extruded hanging block. An end of each of the dumbbell plates is defined with a U-shaped groove where the hanging block is radially slidable, a bump is provided in the U-shaped groove, and the bump and a wall of the U-shaped groove define a limiting area therebetween, the hanging block can slide into the limiting area and be latched with the bump during the hanging block rotating in the U-shaped groove.

6 Claims, 10 Drawing Sheets

WEIGHT ADJUSTABLE DUMBBELL

TECHNICAL FIELD

The present disclosure relates to a physical exercise equipment, and particularly to a weight adjustable dumbbell.

BACKGROUND

A dumbbell is a simple equipment for strengthening muscle strength training. A conventional dumbbell can be a weight-fixed type or a weight adjustable type, a regular adjusting manner of weight adjustable dumbbell is mounting dumbbell plates onto the dumbbell according to the specific request of weight, then lock the dumbbell plates by pressing screws, thus this kind of adjusting manner have to be achieved by mounting and detaching dumbbell plates continuously, and the operation is relatively complicated.

Chinese Patent CN205867408U discloses a weight adjustable dumbbell which facilitates the adjustment operation. This kind of weight adjustable dumbbell has dumbbell plates with different weights placed on a base as a spare. While adjusting, the dumbbell bar rotates by the rotating of the adjusting dials on the two sides thereof, a plurality of protruded wheels on the dumbbell bar also rotate synchronously, the dumbbell bar is fixedly connected to the dumbbell plates by latching the protruded wheels into the round holes in the center of the dumbbell plates, thereby facilitating the adjusting operation. However, since the dumbbell bar and the dumbbell plates are only locked and latched by abutting the embosses in the round holes onto the protruded wheels, the dumbbell plates sometimes can be dropped out easily, causing higher security risks.

SUMMARY

The present disclosure is aimed to provide a weight adjustable dumbbell with operation security and secured latching of the dumbbell plates.

The technical purpose of the present disclosure can be solved by the following technical solutions:

A weight adjustable dumbbell, which includes a dumbbell bar assembly, a dumbbell base and a plurality of dumbbell plates placed on two sides of the dumbbell base. The dumbbell bar assembly includes a plurality of synchronously rotatable hanging plates arranged adjacently, an end of each of the hanging plates is provided with an extruded hanging block. An end of each of the dumbbell plates is defined with a U-shaped groove where the hanging block is radially slidable, a bump is provided in the U-shaped groove, and the bump and a wall of the U-shaped groove define a limiting area therebetween, the hanging block can slide into the limiting area and be latched with the bump during the hanging block rotating in the U-shaped groove.

By adopting the above-mentioned technical solution, during weight adjustment, the dumbbell plates make use of the limiting area formed between the bump and a wall of the U-shaped groove in order to connect the dumbbell plates and the hanging plates, such that the dumbbell plates and the hanging plates can be limited in the radial direction. Also, the interference fit between the hanging plates and the limiting area is achieved, such that the dumbbell plates and the hanging plates can be limited in the peripheral direction. Additionally, the hanging plates are limited by the bumps, the bumps are abuts to the hanging plates with a relatively large contacting area therebetween, such that the dumbbell bar assembly can carry dumbbell plates with higher weight while ensuring the security during exercise, preventing the dumbbell plates from dropping out.

Preferably, the cross section of the hanging block is arc-shaped, and at least one of the hanging block is evenly arranged along an outer periphery of the hanging plate.

By adopting the above-mentioned technical solution, the arc-shaped cross section of the hanging plate can better fit the wall of the U-shaped groove while the hanging plate is rotating in the U-shaped groove. Additionally, an arc-shaped limiting groove is formed in the hanging plate, so as to facilitate the bump latching onto the inner side of the hanging plate, thereby enhancing the strength of connection. Moreover, the plurality of hanging blocks make the weight adjustment available no matter which direction the hanging plates are rotating to, making it easier to operate and adjust.

Preferably, arc length of the hanging block on each of the hanging plates decreases or increases sequentially.

By adopting the above-mentioned technical solution, the hanging plate with larger curved hanging block connects to the dumbbell plates at first, and the hanging plate with lower-arc with smaller curved hanging block connects to the dumbbell plates at last. Since the arc of the hanging block on each of the hanging plates decreases or increases sequentially, the hanging plates can sequentially connect to the dumbbell plates according to the need, thereby facilitate the adjustment and arrangement of the weight.

Preferably, the two adjacent hanging plates are latched to each other to be fixed.

By adopting the above-mentioned technical solution, the latching connection, as a kind of detachable connection manner, facilitates the mounting and detachment of the adjacent hanging plates.

Preferably, a regular polygonal groove is defined on a side of the hanging plate, and another side of the hanging plate is provided with a regular polygonal block corresponding to the regular polygonal groove.

By adopting the above-mentioned technical solution, the fast connection between two adjacent pegs is achieved by using the regular polygonal block on one of the hanging plates to snap into the regular polygonal groove on the other. Also, the connection between the regular polygonal block and the regular polygonal groove can better transfer torque in the circumferential rotation, so as to avoid the relative rotation of the hanging plates connected to each other, in order to avoid slippage and ensure the stability of the weight adjustment process.

Preferably, the dumbbell bar assembly further includes a dumbbell bar successively extending through the hanging plates and a handle tube sleeved on the dumbbell bar and rotatable relative to the dumbbell bar, the hanging plates are located on two sides of the handle tube in equal quantities, both end of the handle tube is connected to the adjacent hanging plates, respectively; and the handle tube is synchronously rotatable with the hanging plates.

By adopting the above-mentioned technical solution, all of the hanging plates at both ends of the handle tube can be rotated synchronously by rotating the handle tube during the weight adjustment. In addition, the hanging plates on both sides of the handle tube can rotate synchronously to achieve synchronous adjustment, so that the dumbbell plates on both sides of the handle tube are the same after the weight adjustment, which is more convenient for adjustment operation.

Preferably, the dumbbell bar assembly further includes a stop mechanism connected to one side of the handle tube, the stop mechanism includes a first cap sleeved on the dumbbell bar and connected to the dumbbell bar, a stop plate received in one side of the first cap and rotatable relative to the first cap, and a stop component received in the first cap slidable along a radial direction of the first cap; the stop plate comprises a plurality of limiting latches evenly arranged along a periphery of the first cap, and the limiting latches are extruding to one side of the first cap, two adjacent limiting latches forms a limiting notch therebetween, and the handle tube is locked while the stop component slides into the limiting notch.

By adopting the above-mentioned technical solution, after the weight adjustment and when the dumbbell is not used, the handle tube is kept locked by the connected stop mechanism, which is achieved by the stop component in the first cap that snaps into the limiting notch that rotates synchronously with the handle barrel, and it is necessary to push the stop component to disengage it from the limiting notch to operate, thus ensuring the security when using/not using.

Preferably, the dumbbell base has a first limiting groove capable of receiving a part of the first cap, and a protruded thimble is located in the first limiting groove, the thimble can push the stop component to approach an axis of the first cap and to separate from the limiting notch, and an elastic component permanently pushing the stop component radially away from the axis of the first cap is mounted inside of the first cap.

By adopting the above-mentioned technical solution, during the weight adjustment, the dumbbell bar assembly needs to be placed on the base, and the thimble on the base will squeeze the stop component to make it move radially and disengage from the limiting notch on the stop plate, so as to complete the unlocking operation of the handle tube. The dumbbell can be unlocked and adjusted with one hand, and can only be unlocked when the dumbbell bar assembly is placed on the dumbbell base, thus the security is higher.

Preferably, one side of the handle tube is connected a dial synchronously rotatable with the stop plate.

By adopting the above-mentioned technical solution, the rotation of the handle tube can drive the rotation of the dial, such that the weight of the dumbbell plates mounted on the dumbbell bar can be more vividly known from the dial, facilitating the controlling of the rotation angle of the handle tube.

Preferably, the dumbbell bar assembly further comprises a second cap, a weight block detachably connected to the second cap, and a connecting block connecting the first and the second cap. The connecting block can be latched into the U-shaped groove, and the hanging plates are located between the first and the second caps.

By adopting the above-mentioned technical solution, the second cap, as a limiting component of the hanging plates in the axial direction, is connected to the first cap by the connecting block, such that the hanging plates on one side of the handle tube can be limited in the axial direction. Additionally, when no dumbbell plate is connected to the dumbbell bar assembly, the weight plate connected to the second cap can be used as a load, ensuring that the dumbbell bar assembly has a certain weight. Also, since the first and the second caps has certain weights themselves, the first and second caps can also be used as the weight plates, increasing the adjustment range of the weight of the dumbbell.

Accordingly, the present disclosure has the following beneficial effects:

1. By setting different hanging blocks with different arcs on the hanging plates, the dumbbell plates are rotated and latched into the limiting area formed by the bumps and the wall of the U-shaped groove to realize the locking connection between the dumbbell plates and the hanging plates, thereby improving the security of the dumbbell plates while using, and preventing the dumbbell plates from dropping out.

2. By rotating the handle tube to drive the rotation of the hanging plates on both sides, a synchronous adjustment of weight is achieved. Additionally, a stop mechanism is mounted to limit the rotation of the handle tube, while the dumbbells are not using or after the weight adjustment is finished, the handle tube can be rotationally locked, so as to improve the security of use.

REFERENCE NUMBER

Figure 1:
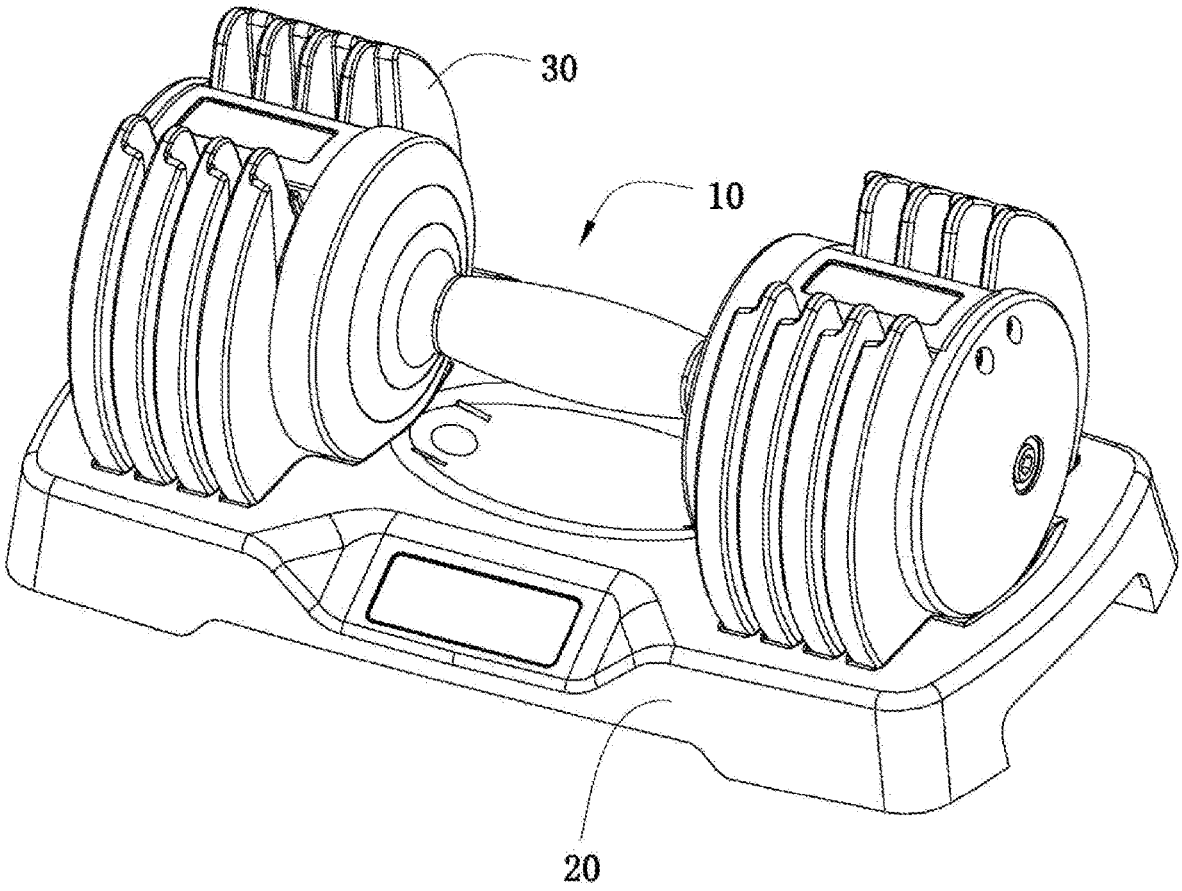
FIG. 1 is a perspective view of a weight adjustable dumbbell according to an embodiment of the disclosure.

10. dumbbell bar assembly 11. dumbbell bar 111. handle tube 112. first limiting block 113. first screw 114. second screw 115. connecting block 12. second cap 13. weight block 14*a*. first hanging plate 14*b*. second hanging plate 14*c*. third hanging plate 14*d*. fourth hanging plate 141. supporting post 142. regular polygonal block 143. hanging block 144. regular polygonal groove 145. reserved groove 15. first cap 151. mounting groove 152. ring groove 153. sliding groove 16. stop plate 161. limiting latch 162. limiting notch 163. first connecting recess 17. dial 171. through hole 172. second connecting recess 173. second limiting block 18. stop component 181. locking block 1811. avoiding recess 1812. connecting post 182. button block 1821. connecting hole 19. elastic component 20. dumbbell base 21. first limiting groove 22. second limiting groove 23. third limiting groove 24. thimble 30. dumbbell plate 31. U-shaped groove 32. Y-shaped notch 33. bump 34. limiting area.

DETAILED DESCRIPTION OF THE EMBODIMENTS

The present disclosure will be further described in detail below with reference to the drawings.

Figure 2:
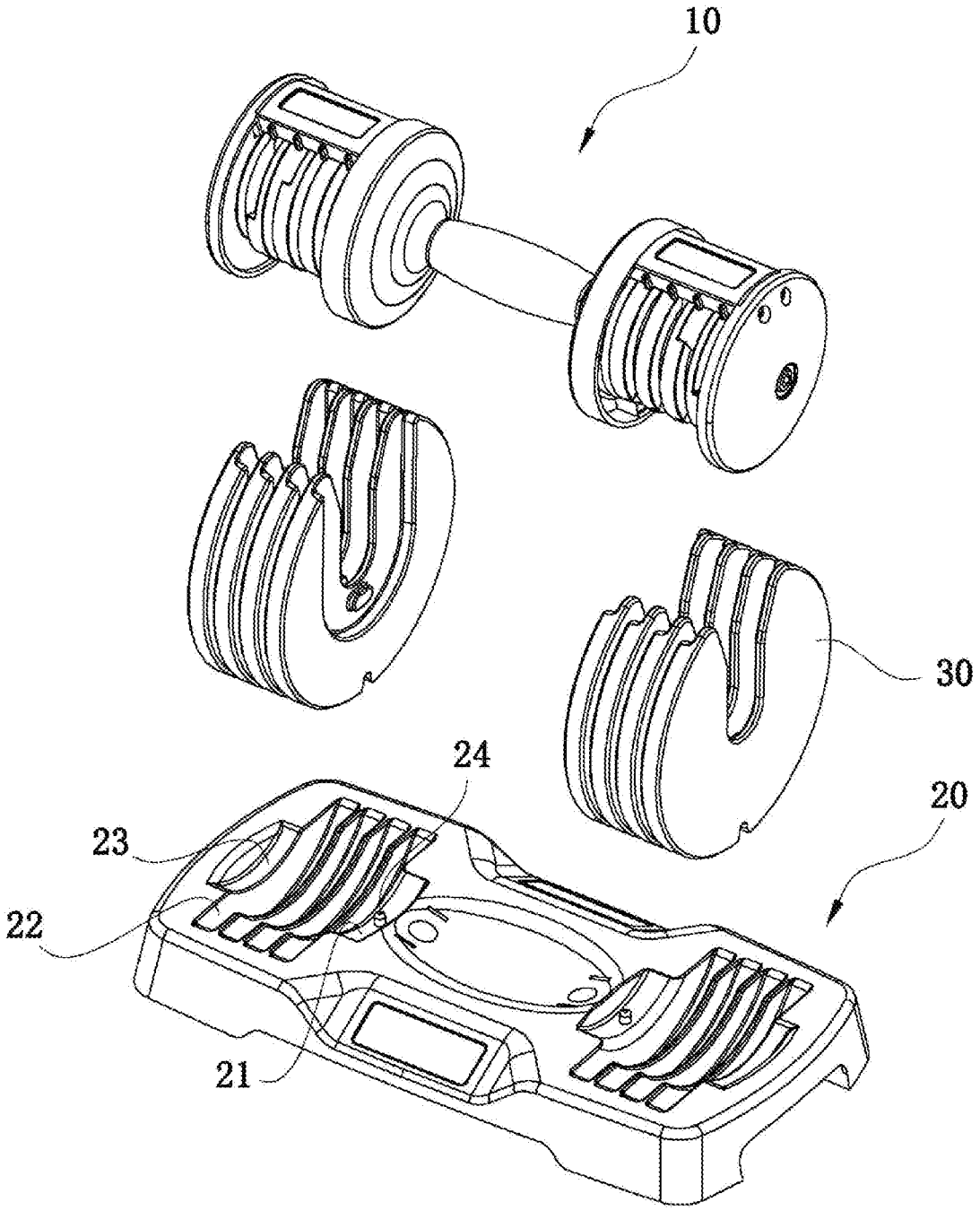
FIG. 2 is an exploded view of the weight adjustable dumbbell.

Referring to FIG. 1 and FIG. 2, a weight adjustable dumbbell includes a dumbbell base 20, a plurality of dumbbell plates 30 and a dumbbell bar assembly 10. The dumbbell plates 30 can be connected to both sides of the dumbbell bar assembly 10, so as to achieve the adjustment of the weight.

Both sides of the dumbbell base 20 has a second limiting groove 22 for the dumbbell plates to be latched into, respectively. Both sides of the second limiting groove 22 has a first limiting groove 21 and a second limiting groove 22.

A thimble 24 is located in the first limiting groove 21, and part of the thimble 24 is extruded from the surface of the first limiting groove 21.

Figure 3:
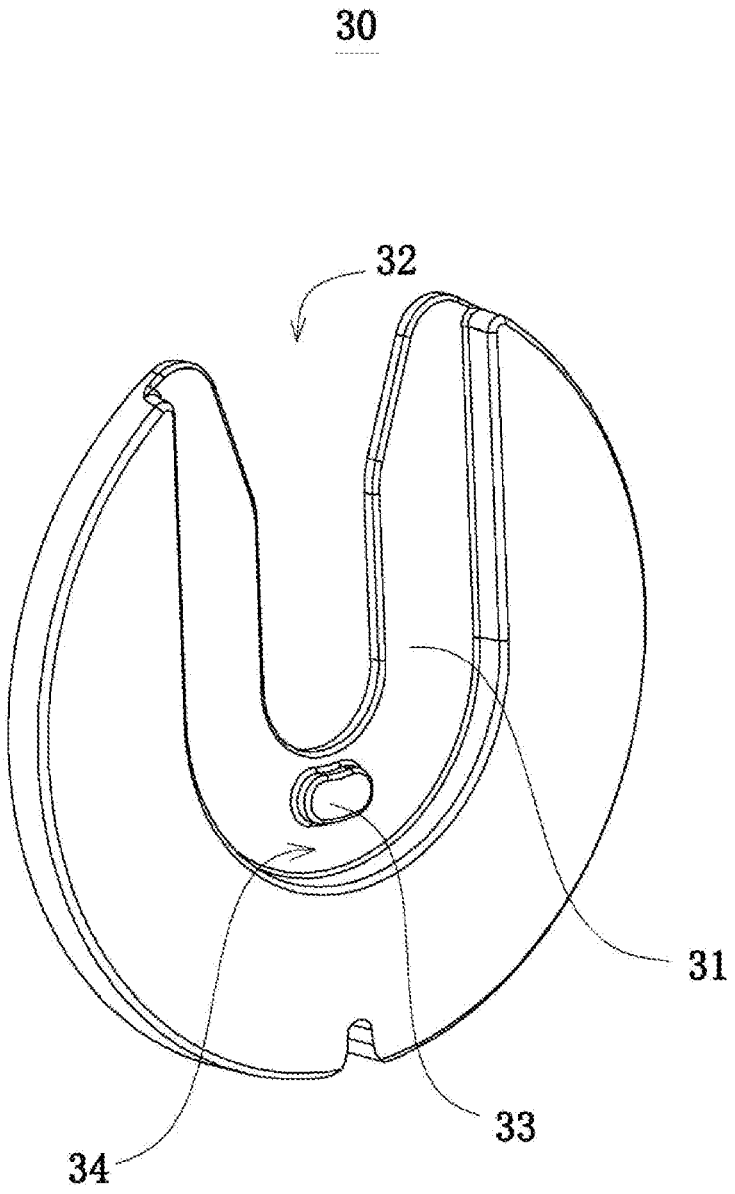
FIG. 3 is a perspective view of a dumbbell plate.

Referring to FIG. 3, each of the dumbbell plates 30 are round-shaped. One side of each of the dumbbell plates 30 is located with a U-shaped groove 31, a Y-shaped notch 32 is located in the U-shaped groove 31, and the open shape of the Y-shaped notch 32 can guide the dumbbell bar assembly 10 latch into the notch, as shown in FIG. 2.

A bump 33 is also located in the bottom of the U-shaped groove 31, which is located in the middle of the U-shaped groove 31 and has a gap between the bump 33 and the wall of the U-shaped groove 31, forming a limiting area 34.

Figure 4:
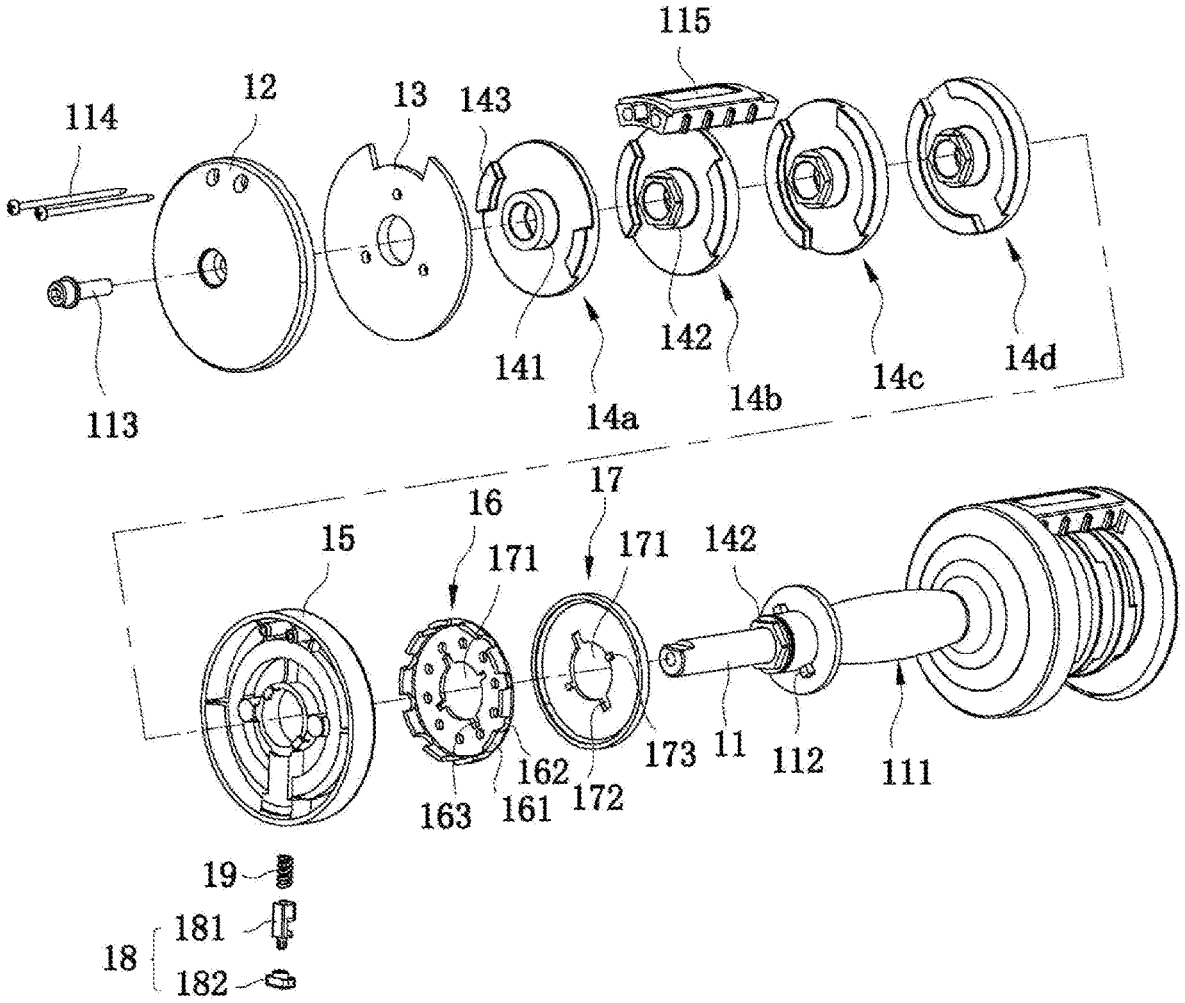
FIG. 4 is an exploded view of a dumbbell bar assembly from a perspective.
Figure 5:
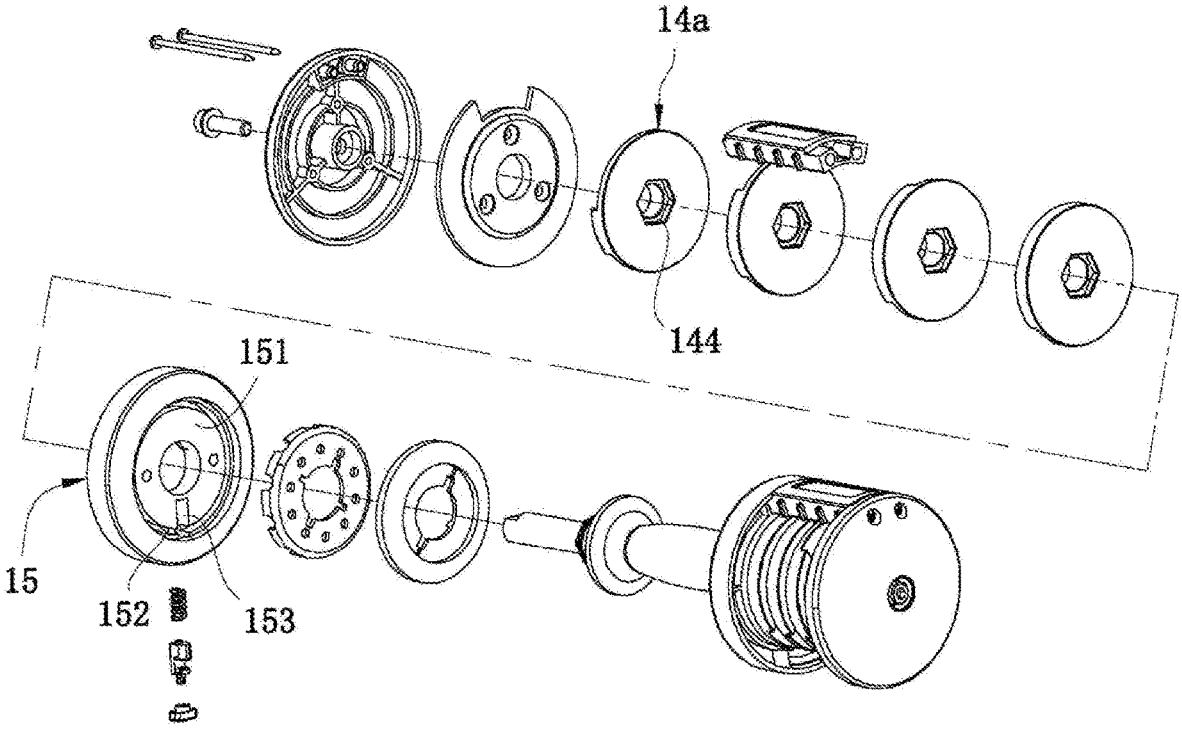
FIG. 5 is an exploded view of the dumbbell bar assembly from another perspective.

Referring to FIG. 4 and FIG. 5, the dumbbell bar assembly includes a long and narrow dumbbell bar 11, a handle tube 111 sleeved on the dumbbell bar 11 and rotatable relative to the dumbbell bar 11, and a plurality of hanging plates located on two sides of the handle tube 111 in equal quantities, the number of the hanging plates is the same of the number of the dumbbell plates 30.

In the illustrated embodiment, four hanging plates are provided. From left to right, the hanging plates are labeled as the first to the fourth hanging plates 14*a*, 14*b*, 14*c*, and 14*d*, all of the hanging plates are sleeve on the handle tube 111, and can rotate synchronously. Each of the hanging plates has a supporting post 141 located in the central hole thereof, and the height of the supporting posts 141 defines the gap between the two adjacent hanging plates. Regular polygonal blocks 142 are located on the second to the fourth hanging plates 14*b*, 14*c*, and 14*d*, respectively. Specifically, the regular polygonal blocks 142 are hexagonal blocks, and the first to the fourth hanging plates 14*a*, 14*b*, 14*c*, and 14*d* all has a regular polygonal groove 144 on a side facing the regular polygonal blocks 144 thereof, respectively. Correspondingly, the regular polygonal grooves 144 are hexagonal, by latching the regular polygonal blocks 142 into the polygonal grooves 144, the synchronous rotation between the adjacent hanging plates is achieved.

Additionally, both side of the handle tube 111 also has the above-mentioned regular polygonal blocks 142, by latching the regular polygonal block 142 into the adjacent fourth hanging plates 14*d*, the rotation of the handle tube 111 can synchronously drive all of the hanging plates on both sides to rotate.

The first to the fourth hanging plates 14*a*, 14*b*, 14*c*, and 14*d* further has two hanging blocks 143 evenly distributed on the periphery. The arc of the hanging blocks 143 on the hanging plates increases in the order from the first hanging plate 14*a* to the fourth hanging plate 14*d*.

The dumbbell bar assembly 10 further includes a first cap 14, a second cap 12, and a connecting block 115 connecting the first cap 15 and the second cap 12. The four hanging plates on one side of the handle tube 11 are limited between the first cap 15 and the second cap 12, the first cap 15 is adjacent to the side of the handle tube 111, and the outer side of the first cap 15 abuts onto the outer side of the handle tube 111. The second cap 12 is fixed to the first cap 15 by two second screws 114 screwing through the threads in the connecting block 115. While the dumbbell bar assembly 10 is placed on the dumbbell 20, the part of the first cap 15 is latched into the first limiting groove 21, and the part of the second cap 12 is latched into the third limiting groove 23, as shown in FIG. 2. The dumbbell bar 11 sequentially extends through the second cap 12, the first to the fourth hanging plates 14*a*, 14*b*, 14*c*, and 14*d*, and the first cap 15, then a first screw 113 threadly connecting to one side of the dumbbell bar 11 is used to limit all of the above-mentioned components.

The second cap 12 also has a weight block 13 located inside thereof connected by a latching component, such that the dumbbell bar assembly 10 has a certain weight with no loads. Of course, the first cap 15, the second cap 12, and the connecting block 115 can also be a weight when no load is loaded. In details, the state of no load means a state of the dumbbell bar assembly 10 with no dumbbell plate 30 connected onto it.

The dumbbell bar assembly 10 further include a stop mechanism used to limit the rotation of the handle tube 111, and the stop mechanism is located in the side of the first cap 15. Specifically, it includes a stop plate 16 and a stop component 18 mounted inside of the first cap 15. The side of the first cap 15 facing the handle tube 111 has a mounting groove 151, the stop plate 16 is received in the mounting groove 151, and the stop plate 16 can be rotated in a peripheral direction relative to the first cap 15. Specifically, the stop plate 16 includes a plurality of limiting latches 161 evenly arranged along the periphery of the first cap 15, and the limiting latches 161 are extruding to one side of the first cap 15. Two adjacent limiting latches 161 has a gap forms a limiting notch 162 therebetween, and a ring groove 152 is located in the mounting groove 151, the limiting latches 161 are latched into the ring groove 152 and can be rotated along the periphery direction of the ring groove 152.

The first cap 15 has a sliding groove 153 along its radial direction, and the stop component 18 is mounted in the sliding groove 153 and can slide along the sliding groove 153. An elastic component 19, preferably a compressed spring, is located in the sliding groove 153. One end of the elastic component 19 abuts to the top of the sliding groove 153, and another end of the elastic component 19 abuts to the stop component 18, since the function of the elastic component 19, the stop component 18 permanently has a trend of moving radially away from the axis of the first cap 15.

Figure 6:
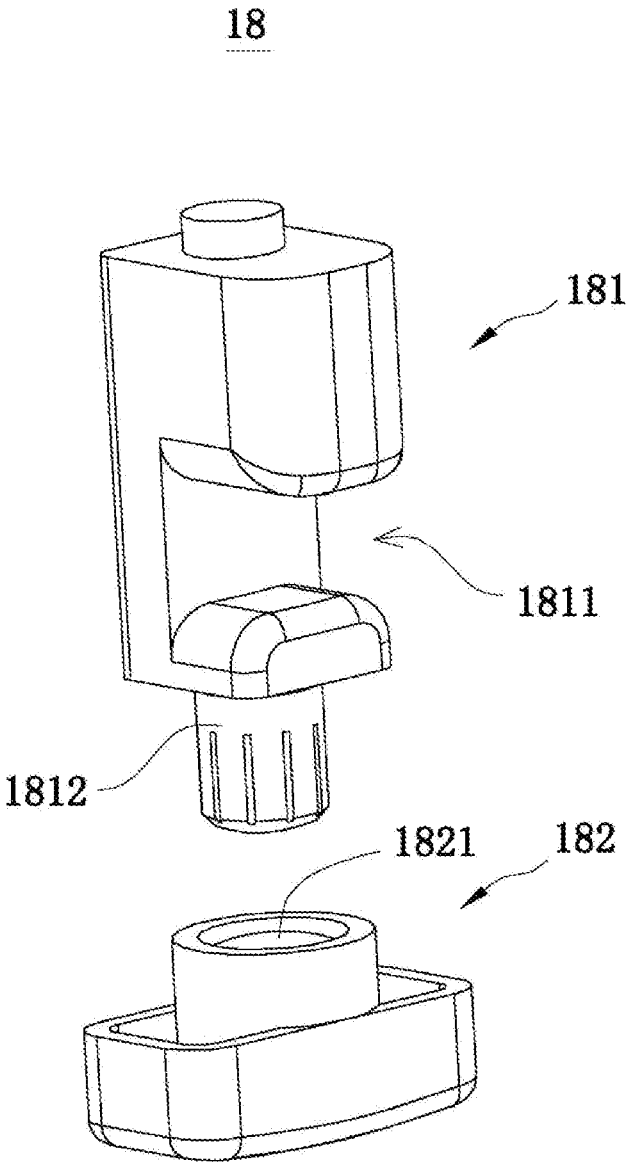
FIG. 6 is a perspective view of a stop component.

Referring to FIG. 4 to FIG. 6, the stop component 18 includes a latching block 181 and a button block 182 connected to each other. Middle area of the latching block 181 has an avoiding recess 1811, where the limiting latches 161 can be extend through the avoiding recess 1811. The bottom surface facing the button block 182 of the latching block 181 has a connecting post 1812, and a connecting hole 1821 is located on the button block 182, thus the latching block 181 and the button block 182 are connected by latching the connecting post 1812 into the connecting hole 1812. To provide a secure connection between the two, the outer wall of the connecting post 1812 is has an anti-slip strip to increase the friction between the inner wall of the connecting hole 1821 and the outer wall of the connecting post 1812, and the outer wall of the connecting post 1812 is coated with glue to further improve the connection.

The middle of the stop plate 16 has a through hole 171 where the dumbbell bar 11 extending through, the outer periphery of the through hole 171 has four first connecting recesses 163 in communication with the through hole 171, and the four first connecting recesses 163 are evenly arranged in a crossed shape. One side of the handle tube 111 has two first limiting blocks 112, and the first limiting blocks 112 can latch into two of the first connecting recesses 163, such that the stop 16 can synchronously rotate with the handle tube 111.

To facilitate reading the counterweight of the dumbbell plate 30, a dial 17 is provided on the side of the first cap 15, which is embedded in the mounting groove 151 of the first cap 15. An identification arrow (not shown) is provided on the end face of the first cap 15, the arrow is facing the side of the dial 17, functioning as an indication of the reading.

Also, middle of the dial 17 has a through hole 17 where the dumbbell bar 11 extending through, a periphery of the through hole 171 are located with two connecting recesses 172 distributed in 180 degree. The two connecting recesses 172 are corresponding to the two first limiting blocks 112, respectively. The first limiting blocks 112 can not only be latched into the first connecting recesses 163, but also be latched into the connecting recesses 172, thus the handle tube 111 can synchronously rotate with the dial 17. The dial 17 further has two second limiting blocks 173 along the periphery of the through hole 171, and the two second limiting blocks are alternately distributed with the two second connecting recesses 172. The second limiting blocks 173 can be latched into the first connecting recesses 163 of the stop plate 163, achieving the connection between the stop plate 16 and the dial 17.

Figure 7:
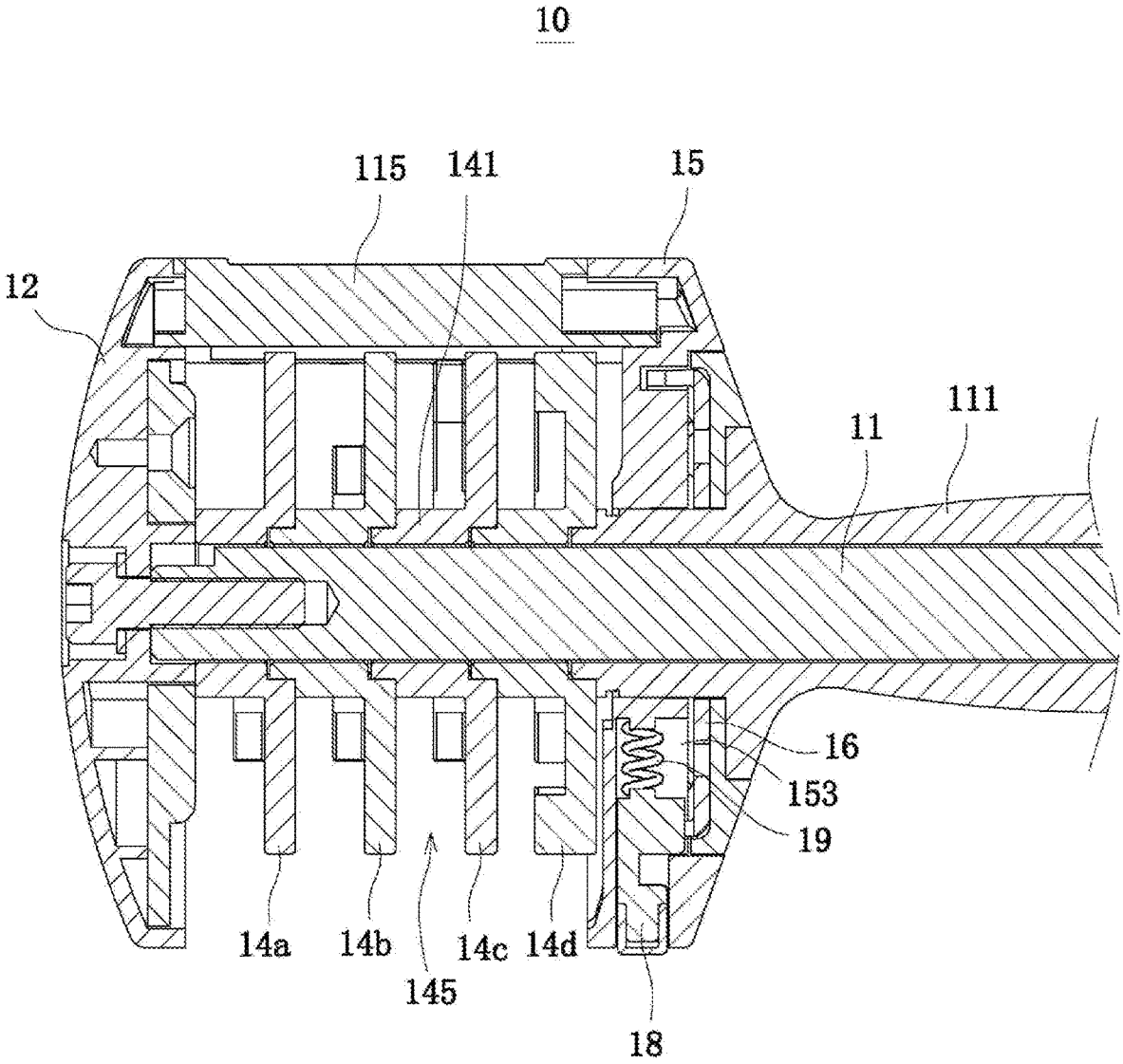
FIG. 7 is a cross-sectional view of a part of the dumbbell bar assembly.

Referring to FIG. 7, the first to the fourth hanging plates 14*a*, 14*b*, 14*c*, and 14*d* are connected to each other, and the supporting posts 141 defines a certain gap between the adjacent hanging plates, where the gaps form reserved grooves 145 to receive the dumbbell plates 30. The width of the reserved grooves 145 is equal to the width of the dumbbell plates 30, such that the dumbbell plates 30 are limited in the axial direction while being received in the reserved grooves 145.

According to the illustrated embodiment, after the weight adjustment or when the dumbbell is not used, the stop component 18 is pushed by the elastic component 19, such that the avoiding recess 1811 is staggered with the limiting recess 162 of the stop plate 16, and the stop component 18 is latched into the limiting recess 162 and lock the stop plate 16, thus the handle tube 111 cannot be rotated in this state, ensuring the security.

Figure 8:
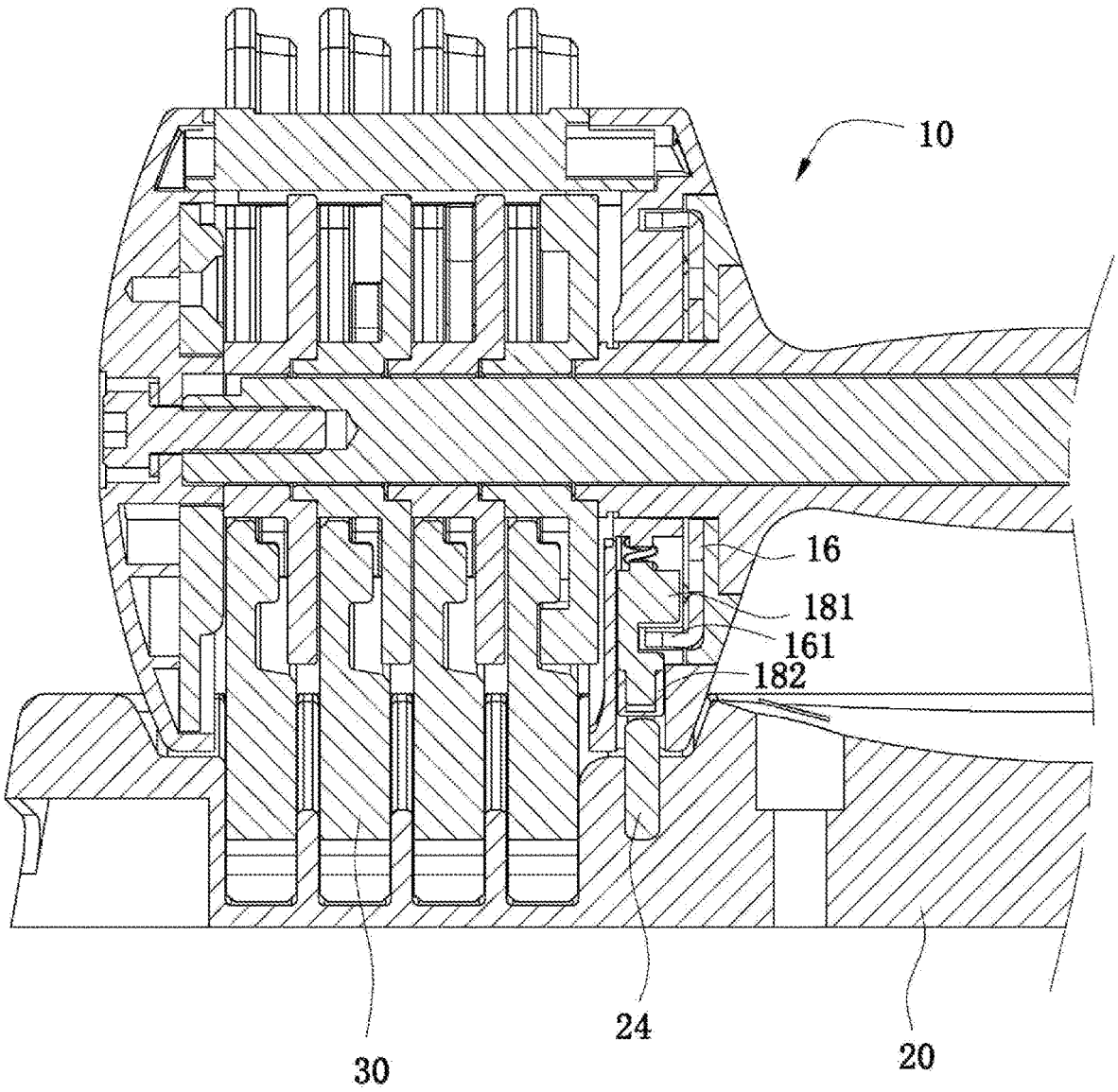
FIG. 8 is a cross-sectional view of a part of the dumbbell bar assembly placed on a dumbbell base.
Figure 9:
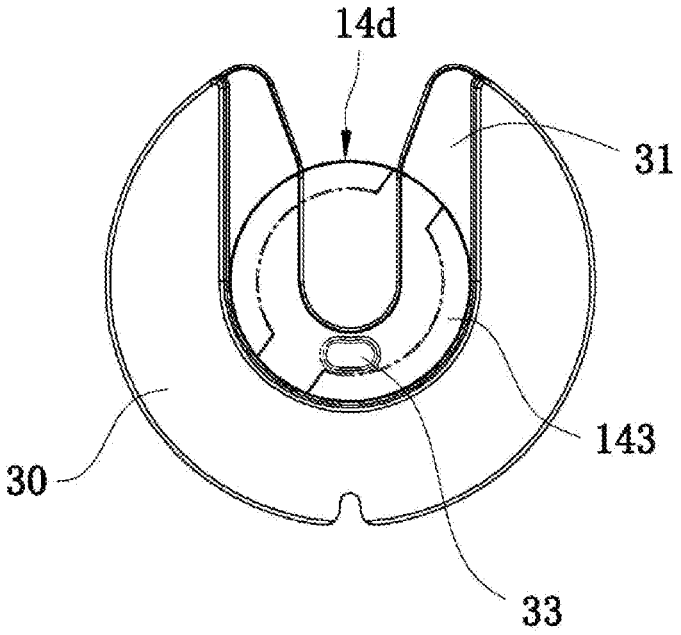
FIG. 9 to FIG. 12 are side views of the first, second, third, and fourth hanging plates showing the connections therebetween.
Figure 10:
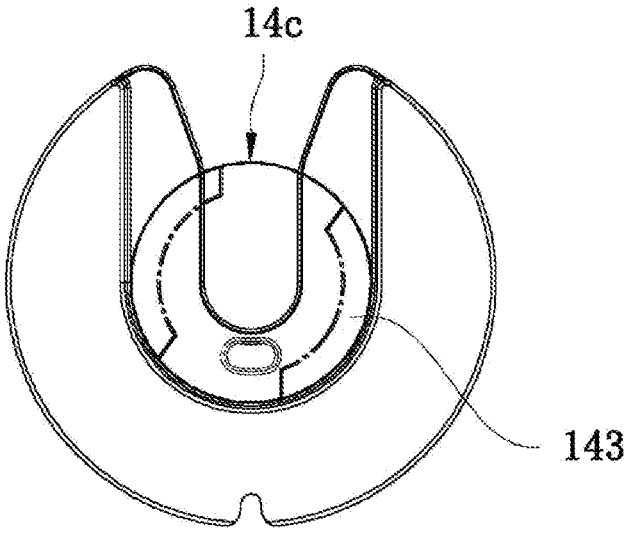
Figure 11:
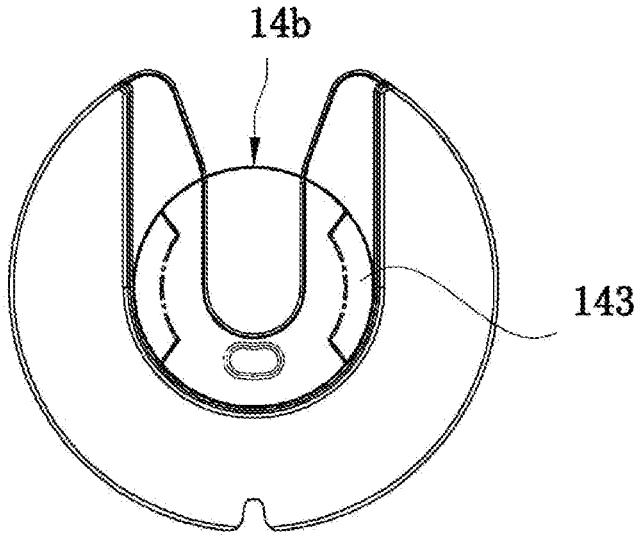
Figure 12:
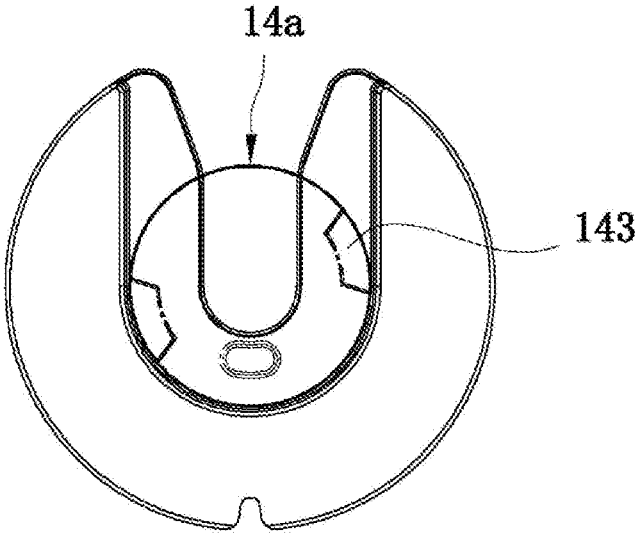

Referring to FIG. 5 and FIG. 8, while adjusting the weight, the dumbbell bar assembly 10 is placed on the dumbbell base 20, and the sliding groove 153 on the first cap 15 is facing the thimble 24 of the base. Therefore, while the dumbbell bar assembly 10 is placing onto the dumbbell base 20, the thimble 24 can push the button block 182 and make the latching block 181 move further to the axis of the first cap, and the elastic component 19 is compressed. While the dumbbell bar assembly 10 is completely placed on the dumbbell base 20, the avoiding notch 1811 of the latching block 181 is located where the limiting latches 161 of the stop plate 16 are, thus in this state the limiting latches 161 can freely pass through the avoiding notch 1811, the stop plate 16 is unlocked, and the handle tube 111 can be rotated.

Referring to FIG. 9 to FIG. 12, the U-shaped grooves 31 on the dumbbell plates 30 can receive any one of the hanging plates, and any one of the hanging plates can move along the radial direction in the U-shaped groove 31, and can rotate peripherally in the U-shaped groove 31. While the dumbbell plates 31 are required to be loaded, the first to the fourth hanging plates 14*a*, 14*b*, 14*c*, and 14*d* are synchronously driven by rotating the handle tube 111, then the hanging blocks 143 of the first to the fourth hanging plates 14*a*, 14*b*, 14*c*, and 14*d* are slowly rotated into the limiting areas 34 of the dumbbell plates 30 (as shown in FIG. 3). The hanging block 143 with the largest arc on the fourth hanging plate 14*d* enters the limiting areas 34 at first, and the hanging block 143 with the smallest arc on the first hanging plate 14*a* enters the limiting areas 34 at last. When the hanging blocks 143 entered into the limiting areas 34, the bumps 33 latch onto the inner sides of the hanging blocks 143, and the weight can be adjusted by observing the indication on the dial 17.

While the weight adjustment is finished, the dumbbell bar assembly 10 can be lifted from the dumbbell 20, the elastic component 19 makes the stop component 18 move back, such that the avoiding notch 1811 is staggered with the limiting recess 162 of the stop plate 16 again, then the stop component 18 fixedly latches the stop plate 16, thus the handle tube 111 is locked and cannot be rotated.

The detailed embodiments are merely an explanation of the present disclosure, but not a limitation. And those skilled in the art may, after reading the specification, make modifications to the embodiments as necessary without contributing to the inventive step, provided that they are protected by patent law within the scope of the claims.

What is claimed is:

1. A weight adjustable dumbbell, comprising a dumbbell bar assembly, a dumbbell base and a plurality of dumbbell plates placed on two sides of the dumbbell base, wherein the dumbbell bar assembly comprises a plurality of synchronously rotatable hanging plates arranged adjacently, an end of each of the hanging plates is provided with an extruded hanging block; an end of each of the dumbbell plates is defined with a U-shaped groove where the hanging block is radially slidable, a bump is provided in the U-shaped groove, and the bump and a wall of the U-shaped groove define a limiting area therebetween, the hanging block is capable of sliding into the limiting area and being latched with the bump during the hanging block rotating in the U-shaped groove;

the dumbbell bar assembly further comprises a dumbbell bar successively extending through the hanging plates and a handle tube sleeved on the dumbbell bar and rotatable relative to the dumbbell bar, the hanging plates are located on two sides of the handle tube in equal quantities, respectively; and the handle tube is synchronously rotatable with the hanging plates;

the dumbbell bar assembly further comprising a stop mechanism connected to one side of the handle tube, the stop mechanism comprising a first cap sleeved on the dumbbell bar and connected to the dumbbell bar, a stop plate received in one side of the first cap and rotatable relative to the first cap, and a stop component received in the first cap slidable along a radial direction of the first cap; the stop plate comprises a plurality of limiting latches evenly arranged along a periphery of the first cap, and the limiting latches are extruding to one side of the first cap, two adjacent limiting latches form a limiting notch therebetween, and the handle tube is locked while the stop component slides into the limiting notch; and an elastic component biasing the stop component away from an axis of the first cap is provided inside of the first cap;

a middle of the stop plate is defined with a through hole with the dumbbell bar extending through, a periphery of the through hole is defined with four first connecting recesses in communication with the through hole, the four first connecting recesses are evenly arranged in a crossed shape, one side of the handle tube is provided with two first limiting blocks;

a middle of the first cap is provided with a mounting groove, the stop plate is received in the mounting groove; a ring groove is located in the mounting groove, the limiting latches are latched into the ring groove;

a dial is embedded in the mounting groove of the first cap; the dial is a dish-shaped dial and is coaxial with the stop plate; a middle of the dial is provided with two second connecting recesses; the first limiting blocks are able to be synchronously latched into two of the first connecting recesses and the second connecting recesses, such that the handle tube synchronously rotates with the dial and the stop plate; the dial further comprises two second limiting blocks alternately distributed with the two second connecting recesses; the second limiting blocks are able to be latched into other two first connecting recesses of the stop plate, such that the stop plate is connected to the dial;

a regular polygonal groove is defined on a side of each hanging plate, and another side of each hanging plate is provided with a regular polygonal block corresponding to the regular polygonal groove; one regular polygonal block is also disposed on each side of the handle tube; each regular polygonal block is latched into an adjacent regular polygonal groove, such that all of the hanging plates are synchronously driven by the handle tube to rotate;

the stop component comprises a latching block and a button block connected to each other; a middle area of the latching block is provided with an avoiding recess; the limiting latches are able to pass through the avoiding recess when the elastic component is compressed; the latching block has a connecting post, and the button block has a connecting hole, the latching block and the button block are connected by latching the connecting post into the connecting hole.

2. The dumbbell according to claim 1, wherein a cross section of [each hanging block is arc-shaped, and two hanging blocks are evenly arranged along an outer periphery of each hanging plate.

3. The dumbbell according to claim 2, wherein arc length of the hanging block on each of the hanging plates decreases or increases sequentially.

4. The dumbbell according to claim 1, wherein two adjacent hanging plates of the plurality of hanging plates are latched to each other to be fixed.

5. The dumbbell according to claim 1, wherein the dumbbell base is defined with a first limiting groove capable of receiving a part of the first cap, and a protruded thimble is provided in the first limiting groove, the thimble is capable of pushing the stop component to approach the axis of the first cap and to separate the stop component from the limiting notch; wherein the thimble is configured to push the button block to compress the elastic component.

6. The dumbbell according to claim 5, wherein the dumbbell bar assembly further comprises a second cap, a weight block detachably connected to the second cap, and a connecting block connecting the first and the second cap, the connecting block is capable of latching into the U-shaped groove, and the hanging plates are located between the first and the second cap.

* * * * *